US010487614B2

(12) United States Patent
MacDonald

(10) Patent No.: US 10,487,614 B2
(45) Date of Patent: Nov. 26, 2019

(54) PACKING ELEMENT BACK-UP SYSTEM INCORPORATING IRIS MECHANISM

(71) Applicant: Halliburton Energy Services, Inc., Houston, TX (US)

(72) Inventor: Lorn Scott MacDonald, Inverness (GB)

(73) Assignee: Halliburton Energy Services, Inc., Houston, TX (US)

( * ) Notice: Subject to any disclaimer, the term of this patent is extended or adjusted under 35 U.S.C. 154(b) by 151 days.

(21) Appl. No.: 15/568,255

(22) PCT Filed: May 29, 2015

(86) PCT No.: PCT/US2015/033174
§ 371 (c)(1),
(2) Date: Oct. 20, 2017

(87) PCT Pub. No.: WO2016/195626
PCT Pub. Date: Dec. 8, 2016

(65) Prior Publication Data

US 2018/0142529 A1 May 24, 2018

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/128; E21B 33/1216
See application file for complete search history.

(56) References Cited

U.S. PATENT DOCUMENTS 4,444,404 A 4/1984 Parks, Jr.
4,458,876 A 7/1984 Schaeper et al.
(Continued)

FOREIGN PATENT DOCUMENTS

GB 2488152 A 8/2012

OTHER PUBLICATIONS

International Preliminary Report on Patentability issued in related PCT Application No. PCT/US2015/033174, dated Dec. 14, 2017, 8 pages.

(Continued)

*Primary Examiner* — Blake E Michener
*Assistant Examiner* — Theodore N Yao
(74) *Attorney, Agent, or Firm* — Scott Richardson; Baker Botts L.L.P.

(57) ABSTRACT

An annular sealing assembly and method are disclosed. The assembly includes a mandrel and an expandable element disposed around the mandrel which expands to seal against the inner diameter of a tubing or casing string. The expandable element seals the mandrel from the annulus between the mandrel and the tubing string. The assembly includes at least one back¬up element having a plurality of pivoting blades circumferentially secured in a ring around the mandrel. The back-up element is capable of radially expanding and contracting upon longitudinal movement along, and engagement with, a generally ring-shaped ramp. A guide ring guides the back-up element along the guide ramp. The method is directed to expanding the expandable element to seal the annulus and the back-up element so the blades come in contact with the inner diameter of the tubing string preventing the expandable element from extruding outward into the annulus beyond the back-up element.

19 Claims, 10 Drawing Sheets

(56) References Cited

U.S. PATENT DOCUMENTS

| | | | | |
|---|---|---|---|---|
| 4,460,151 | A | 7/1984 | Williams, III et al. | |
| 5,676,384 | A | 10/1997 | Culpepper | |
| 6,367,804 | B1 | 4/2002 | Watts | |
| 6,782,948 | B2 | 8/2004 | Echols et al. | |
| 6,857,634 | B2 | 2/2005 | Araujo | |
| 6,955,357 | B2 | 10/2005 | Griffin et al. | |
| 7,422,071 | B2 | 9/2008 | Wilkie et al. | |
| 8,555,980 | B1 | 10/2013 | Powell | |
| 8,555,986 | B2 | 10/2013 | Clemens et al. | |
| 8,727,303 | B2 | 5/2014 | Araujo et al. | |
| 9,732,897 | B2 * | 8/2017 | Legendre | E21B 43/0122 |
| 2004/0021269 | A1 | 2/2004 | Gaudette et al. | |
| 2004/0079909 | A1 | 4/2004 | Foster | |
| 2004/0194969 | A1 * | 10/2004 | Hiorth | E21B 33/1216 166/382 |
| 2006/0289173 | A1 | 12/2006 | Conaway et al. | |
| 2011/0048744 | A1 | 3/2011 | Conner et al. | |
| 2011/0073329 | A1 * | 3/2011 | Clemens | E21B 23/01 166/387 |
| 2012/0133098 | A1 * | 5/2012 | Farquhar | E21B 33/128 277/314 |
| 2012/0227987 | A1 | 9/2012 | Castriotta et al. | |
| 2012/0234558 | A1 | 9/2012 | Godfrey et al. | |
| 2013/0126191 | A1 | 5/2013 | Brennan, III et al. | |
| 2015/0308218 | A1 * | 10/2015 | Pray | E21B 33/1216 166/179 |
| 2016/0208573 | A1 * | 7/2016 | Roselier | E21B 33/1216 |
| 2018/0334876 | A1 * | 11/2018 | Zonoz | E21B 33/06 |

OTHER PUBLICATIONS

International Search Report and Written Opinion issued in related PCT Application No. PCT/US2015/033174 dated Feb. 23, 2016, 11 pages.

West Engineering Services, "High Temperature Elastomer Study for MMS", 2009, 27 pages.

* cited by examiner

PACKING ELEMENT BACK-UP SYSTEM INCORPORATING IRIS MECHANISM

CROSS-REFERENCE TO RELATED APPLICATION

The present application is a U.S. National Stage Application of International Application No. PCT/US2015/033174 filed May 29, 2015, which is incorporated herein by reference in its entirety for all purposes.

TECHNICAL FIELD

The present disclosure relates generally to packers for use in isolating regions of a subterranean formation, and, more particularly, to a high expansion back-up system for packers which help maintaining the structural integrity of the packer elements.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore at a desired well site, treating the wellbore to optimize production of hydrocarbons, and performing the necessary steps to produce and process the hydrocarbons from the subterranean formation.

Downhole tools and completion strings may use isolation devices and/or pressure barriers such as packers and others for isolating one zone from another or for isolating a plurality of zones. Some isolation tools are designed to maintain a pressure differential in one direction only, which may be referred to as unidirectional pressure barrier tools and/or unidirectional isolation tools. Other isolation tools are designed to maintain a pressure differential in both directions, which may be referred to as dual directional pressure barrier tools and/or dual directional isolation tools. Pressure on seals may be exerted by reservoir pressures, by pressure applied from the surface into an annulus, and by other pressure sources. Pressure may be exerted by liquids and/or gases. Some isolation devices and/or pressure barrier tools are designed to be deployed, to seal, to unseal, and to be retrieved from the wellbore, which may be referred to as retrievable tools.

Isolation devices may be used when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in which a well bore has been placed. Downhole tools referred to as packers and bridge plugs are designed for these general purposes and are well known in the art of producing oil and gas.

Since downhole conditions can be extreme, certain packers need to be able to withstand the stresses induced by relatively high differential pressures and high temperatures found within such wellbore environments. The assignee of the present disclosure discovered that when using larger packer type tools, or when using packer type tools in higher temperature and/or higher differential pressure environments, such as those having nominal diameters exceeding six (6) inches, temperatures exceeding 250° F., or differential pressures exceeding 10,000 psi, there was a possibility for the segmented packer element back-up shoes, also referred to as back-up rings, to allow the packer element to extrude through gaps that are formed between the packer OD and the tubing or casing ID when the packer element was activated. Upon certain conditions, the larger OD packer elements, and smaller OD packer elements upon being subjected to elevated pressures and temperatures, were subject to being extruded through these gaps thereby possibly damaging the packer element and possibly jeopardizing the integrity of the seal between the wellbore and the packer element. Also, in the high expansion field, the risk of unwanted extrusion is even higher. This is where the back-up rings are not able to provide much resistance to extrusion of the elastomeric element between the large gap formed between the OD of the packer and the tubing or casing ID given the substantial differences in these diameters in such applications.

Thus, there remains a need in the art for packers having back-up elements that prohibit, or at least significantly reduce, unwanted extrusion of packer elements into the annulus formed between the tubing string and wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Figure 1:
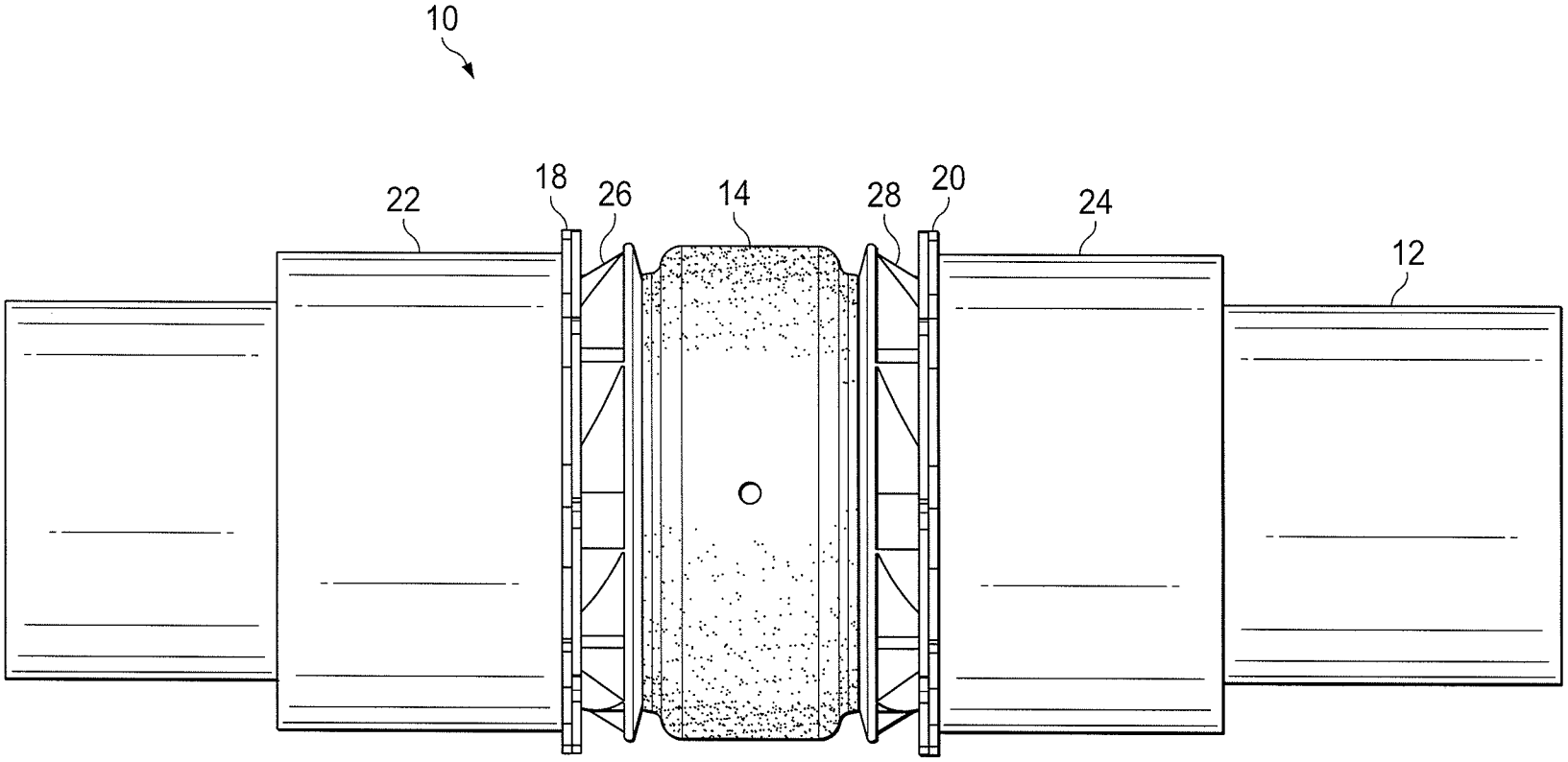
FIG. 1 is a side view of the annular seal assembly in accordance with the present disclosure showing expandable and back-up elements in an unexpanded state.

An annular seal assembly in accordance with the present disclosure is shown generally by reference numeral 10 in the accompanying FIG. 1. The annular seal assembly 10 includes a mandrel 12 which may be a section of production tubing, work string, drill pipe or other downhole piping for use in a wellbore formed in a subterranean formation. The annular seal assembly 10 has use in isolating a particular zone of a subterranean formation by forming a fluid seal with the annulus formed between the production tubing, work string, drill pipe or other downhole piping and the wellbore wall. In most instances, the wellbore wall is lined with a tubing string or casing string. For purposes of this disclosure, the terms tubing string and casing string are intended to be interchangeable.

Figure 2:
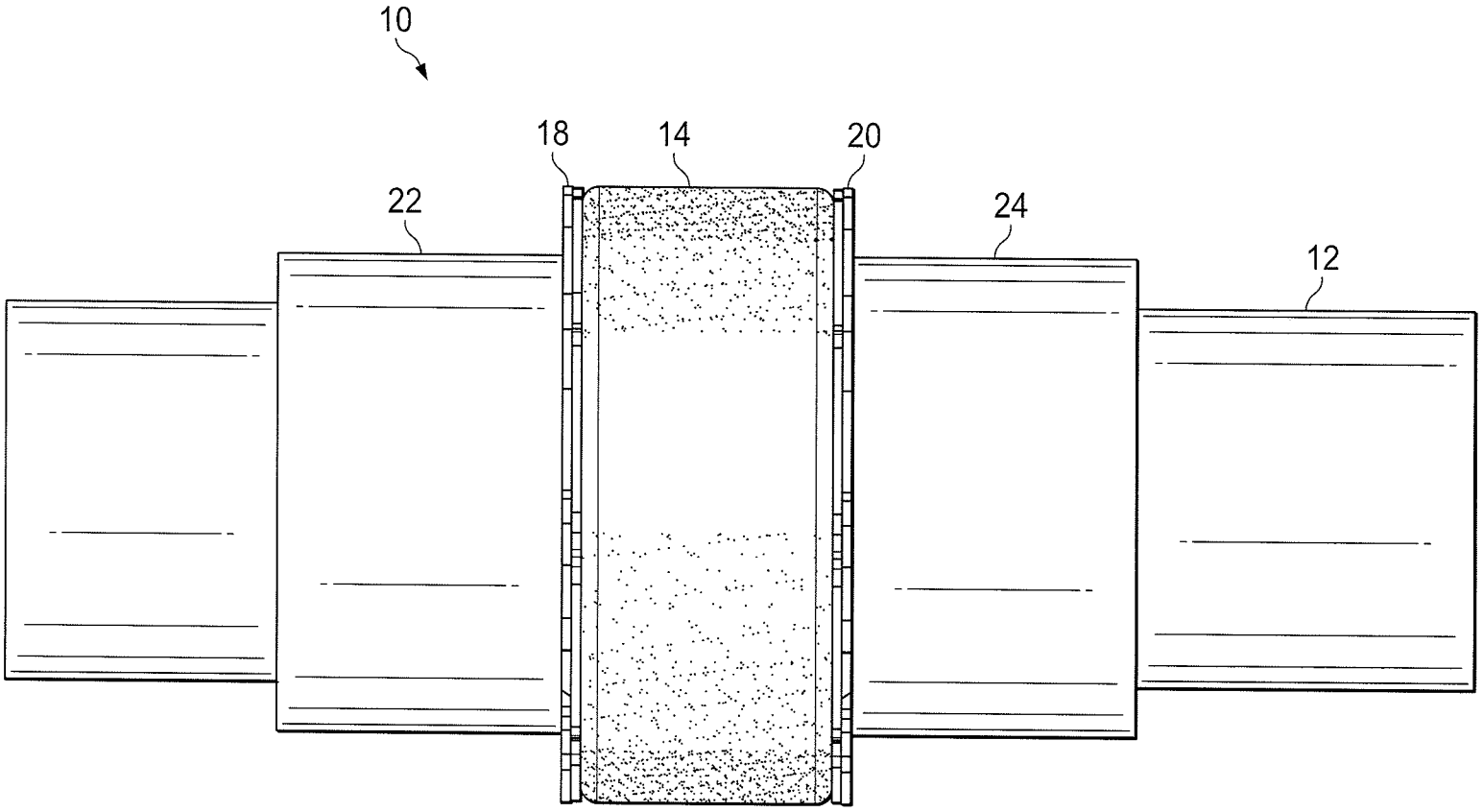
FIG. 2 is a side view of the annular seal assembly in accordance with the present disclosure showing the expandable and back-up elements in an expanded state.
Figure 4:
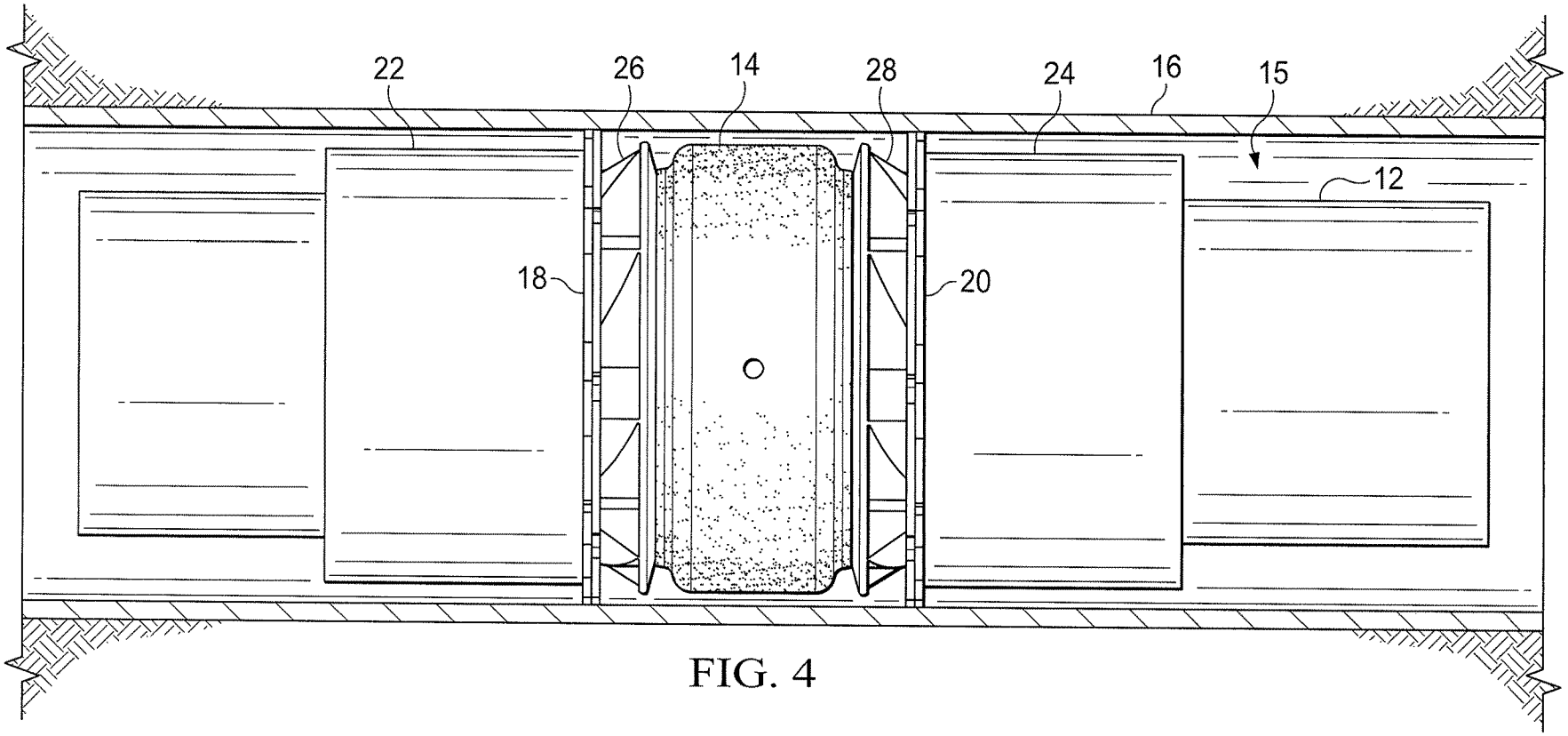
FIG. 4 is a side view of the annular seal assembly showing it inside the inner diameter of a section of tubing string.

The annular seal 10 further includes an expandable element 14, which is disposed on the mandrel. The expandable element 14 is generally tubular in shape and has oppositely disposed longitudinal ends. The expandable element 14 is designed to expand from a contracted position having one outer diameter to an expanded position having a second larger outer diameter, as shown in FIG. 2. In the expanded position, the outer diameter of the expandable element 14 comes into contact with and seals against the inner surface of a tubing string 16, which is shown in FIG. 4. As those of ordinary skill in the art will appreciate there are some applications where the outer diameter of the expandable element 14 will expand directly into contact with the wellbore wall, e.g., in uncased wells. The expandable element 14 may be formed as a swellable elastomeric material, a rubber, certain metallic elements, or other expandable sealing elements and combinations thereof. The expandable element 14 can expand in response to contact with certain fluids either injected into the wellbore or already contained within the wellbore. Alternatively, the expandable element 14 can be formed of a fluid filled bag which inflates in response to fluid being injected into the bag from the surface. Alternatively, the fluid filled bag may contain its own fluid which inflates in response to compressive loading. As those of ordinary skill in the art will appreciate, there are other known mechanisms which can be used as the expandable element 14.

The annular sealing assembly 10 further includes a pair of back-up elements 18 and 20, which are disposed around the mandrel 12 one on each of the opposite longitudinal ends of the expandable element 14, as shown in FIGS. 1-4. In an alternate embodiment, only one back-up element may be provided. The back-up elements 18 and 20 are designed to contain the expandable element so that it does not extrude out into the annulus and thereby jeopardize the integrity of the seal formed with the inner surface of the tubing string 16 in the expanded state. The back-up elements 18 and 20 are moved axially inward toward the expandable element 14 by a pair of guide rings 22 and 24, which are disposed around the mandrel 12 adjacent the opposite longitudinal ends of the expandable element 14. In one embodiment, one of the pair of guide rings 22 and 24 is fixed to the mandrel 12 while the other is permitted to move axially. In another embodiment, both guide rings 22 and 24 are permitted to move axially along the outer surface of the mandrel 14. The guide rings 22 and 24 guide the back-up elements 18 and 20 along an associated pair of guide ramps 26 and 28. The guide ramps 26 and 28 are disposed around the outer circumferential surface of the mandrel 12 and are generally ring-shaped.

Figure 5A:
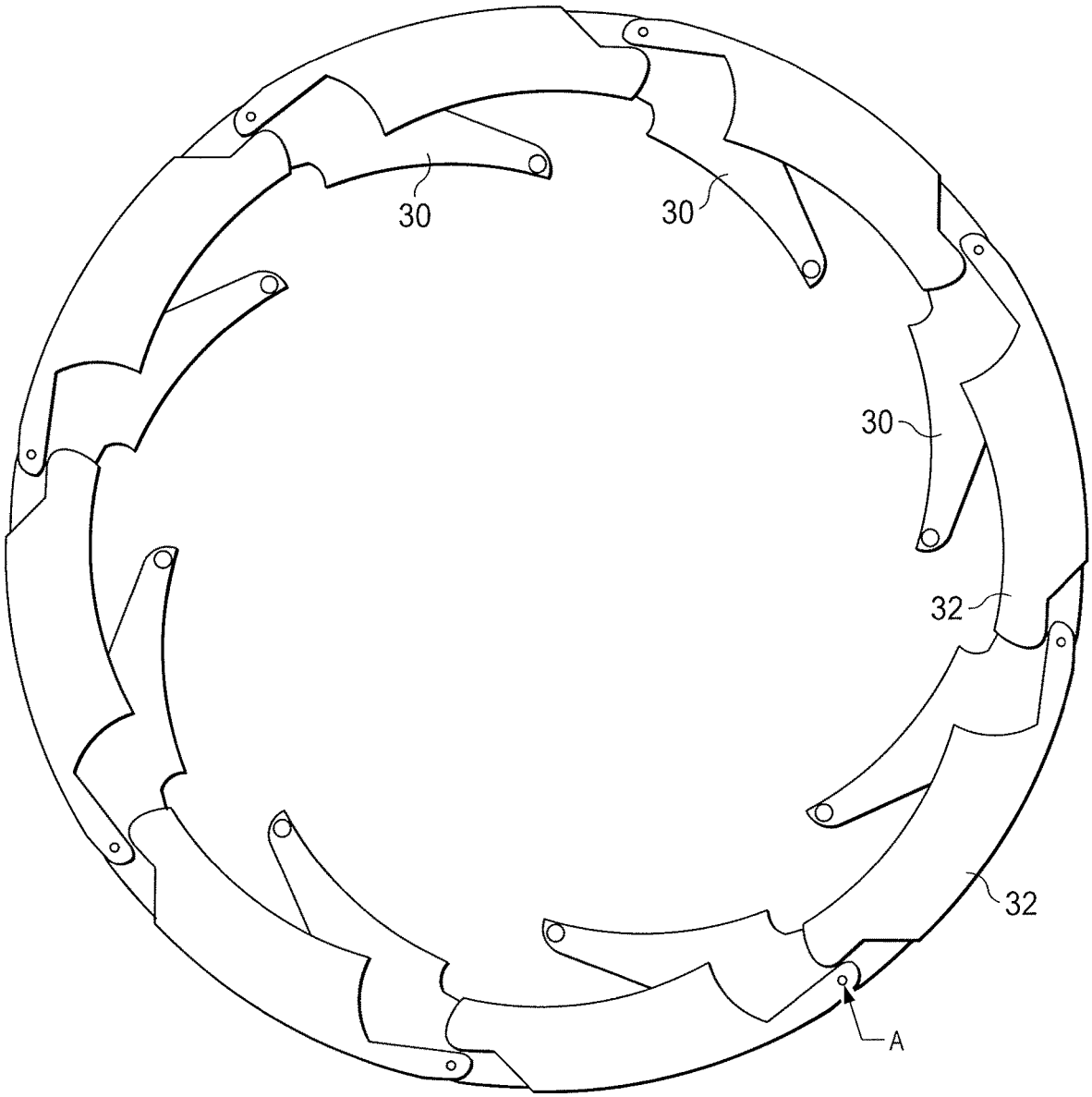
FIGS. 5A and 5B are side views of the back-up element illustrating the plurality of pivot blades in the expanded and retracted positions, respectively.
Figure 5B:
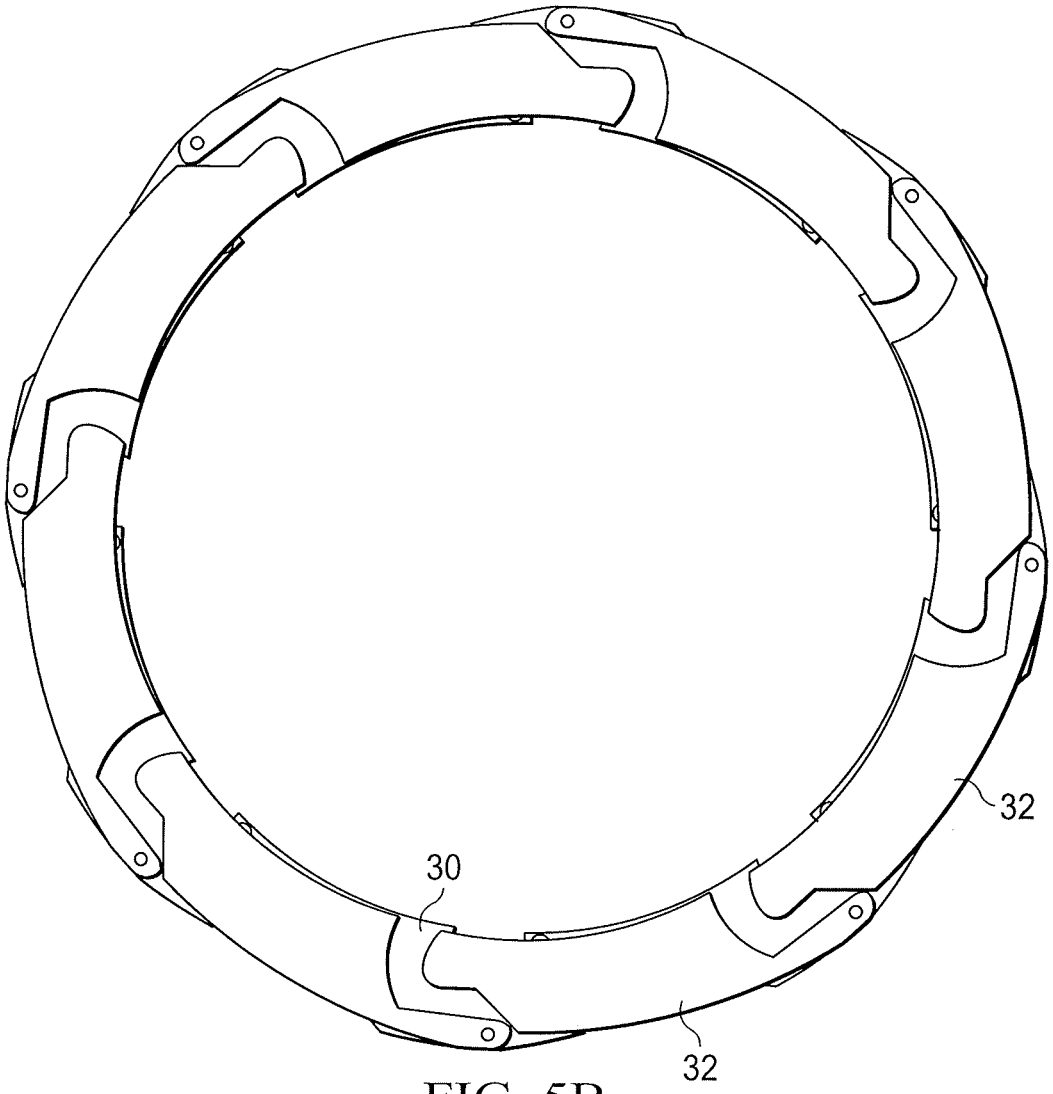

Each of the back-up elements 18 and 20 is formed of a plurality of pivoting blades as shown in FIGS. 5A and 5B. The construction of the back-up elements 18 and 20 is somewhat complex. It is formed of two sets of pivoting blades that enable one set to pivot relative to the other such that the back-up elements 18 and 20 expand and retract much in the same way that a human iris does in response to light changes. The first set of blades 30 making up the back-up elements, which are shown in FIG. 5A with one arm projecting inward, have a shape similar to a bomerang. In other words, each blade is forming of two arms, which intersect to form an obtuse angle. The second set of blades 32 making up the back-up elements, also shown in FIG. 5A, has a shape similar to that of a meat cleaver. In other words, it has a long straight body which is wide with a narrower section which projects from the main body that forms what would be the equivalent of the handle portion of the meat cleaver. The second set of blades 32 have generally arcuate-shaped back sides, which when connected together as shown in FIGS. 5A and 5B, form an outer circumferential surface of the back-up elements 18 and 20. Similarly, the first set of blades 30 have generally arcuate-shaped inner surfaces along each of its arms, which when connected together and in the retracted position as shown in FIG. 5B, form an inner circumferential surface of the back-up elements 18 and 20. These shapes are important to the expanded and retracted positions of the iris mechanism to allow movement of adjacent blades and the specific shape required evolves naturally from the required expansion/retraction movement necessary per blade, which is dependent on tool geometry and tubing ID.

The blades of the first set 30 are interspersed between the blades of the second set 32 such that they alternate with each other in their placement around the circumference making up the back-up elements. The blades of the second set 32 are fixed, and pivot relative, to the blades of the first set 30. They do so at a location that is at the end of the narrow section of the blade of the second set and the approximate mid-section of the blade of the first set, as illustrated by Point A in FIG. 5A. The plurality of pivot blades making up each of the back-up elements 18 and 20 have an OD ("outer diameter") which is less than the OD of the expandable element 14 and an ID ("inner diameter") which conforms to the OD of the mandrel 12 when the pivoting blades are in the retracted position. The plurality of pivot blades making up each of the back-up elements have an OD which conforms to an ID of a section of tubing string into which the annular sealing assembly may be placed when the pivoting places are in the expanded position.

Figure 6:
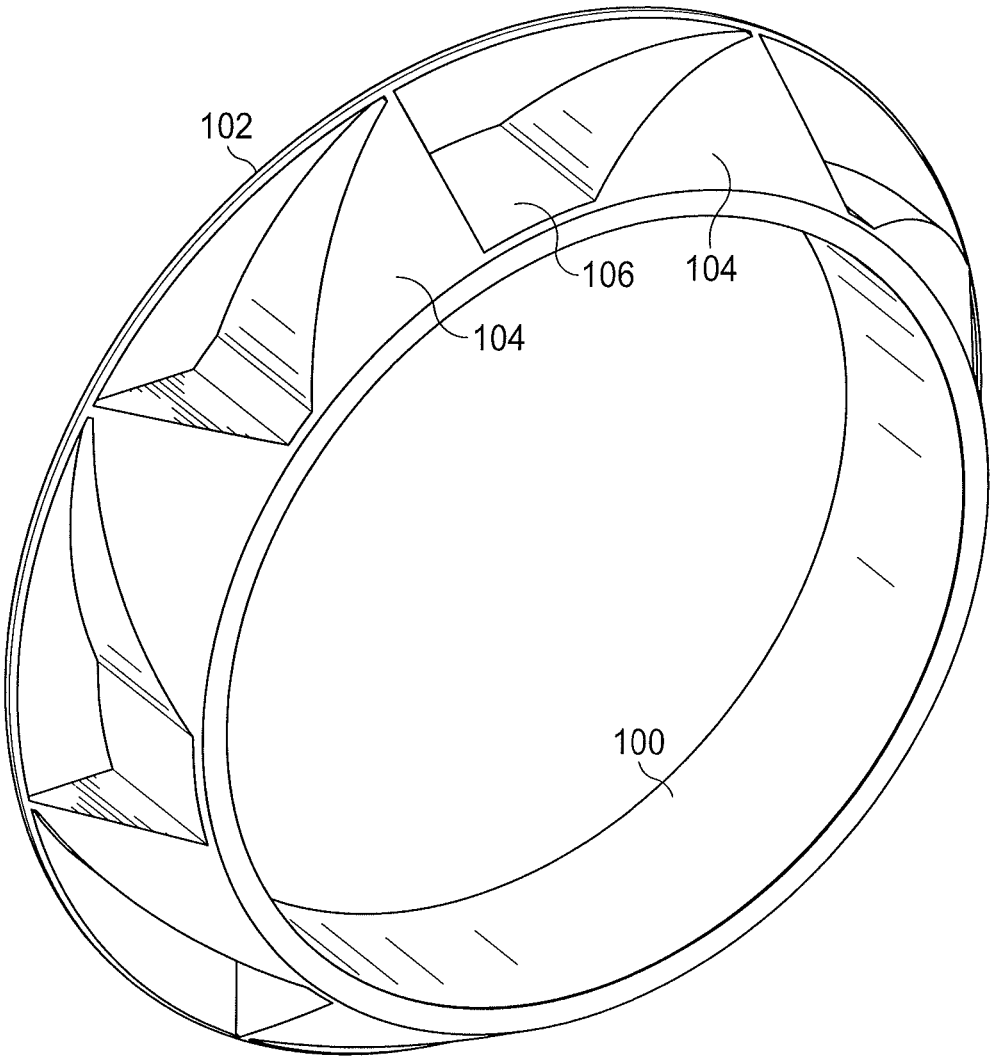
FIG. 6 is a side perspective view of a generally ring-shaped guide ramp along which the back-up element moves.
Figure 7:
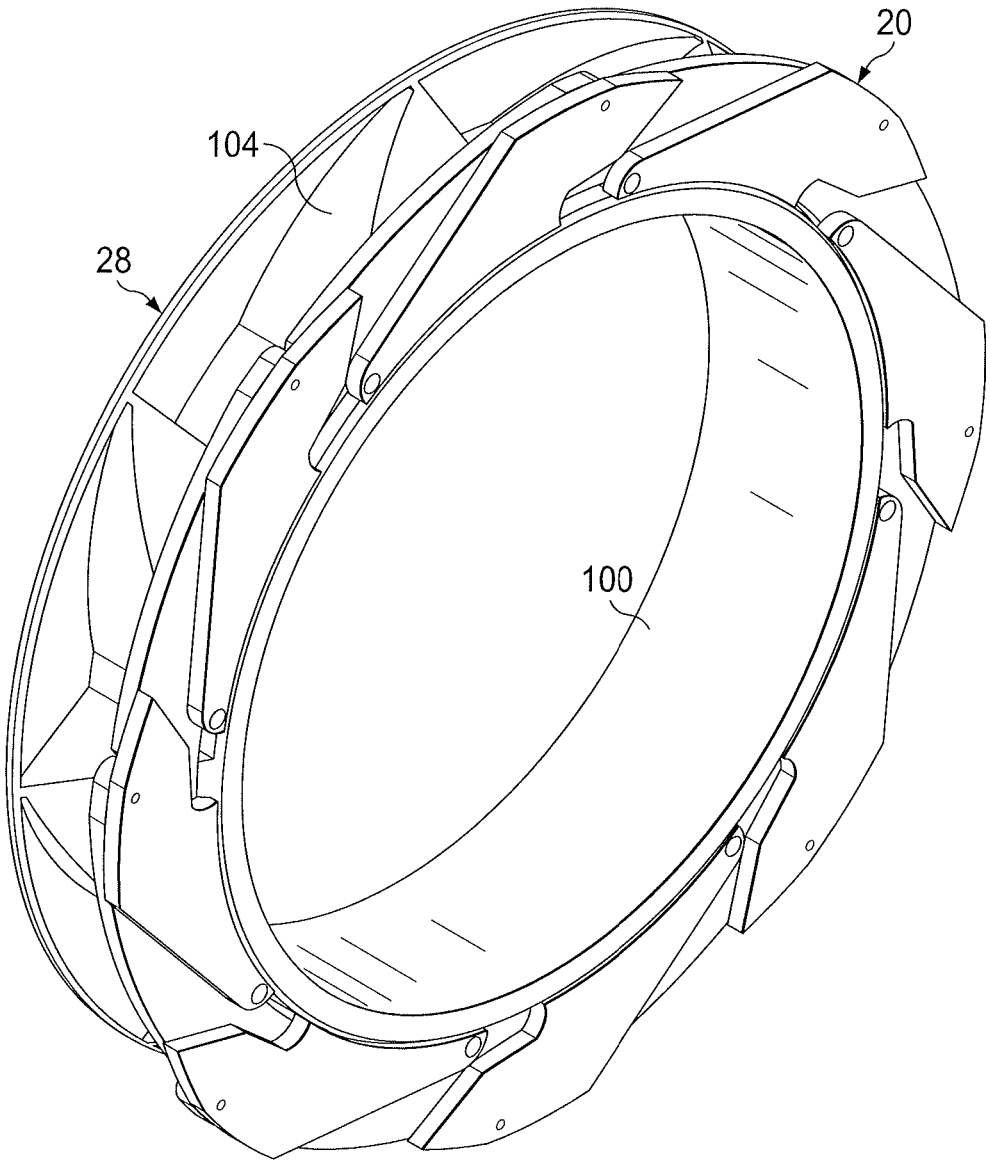
FIG. 7 is a perspective view of the back-up element and an associated generally ring-shaped guide ramp showing pivot blades making up the back-up element in a retracted state.

The blades making up the back-up elements 18 and 20 expand and contract as they ride along the guide ramps 26 and 28, shown in FIGS. 1, 4 and 6-8. The guide ramps 26 and 28 are each formed of an first ring 100 which has a generally flat surface oriented in the axial direction, as shown in FIG. 6. The first ring 100 is designed to fit over the outer circumferential surface of the mandrel 12. The guide ramps 26 and 28 include a second ring 102 which is generally perpendicular to the first ring 100 and has a flat surface oriented in the radial direction, as shown in FIG. 6. The first and second rings 100 and 102 are integrally formed with one another as one piece. Each of the guide ramps 26 further include a plurality of ramps 104. Each of the plurality of ramps 104 projects radially outward from the first ring 100 and taper radially and axially. The number of ramps 104 corresponds directly to the number of blades in first set of blades 30 making up the back-up elements 18 and 20. The blades of the first set 30 ride along the ramps 104, whose tapered surface forces the blades to pivot relative to the blades in the second set 32 thereby causing them to project radially outward, which in turn is what causes the back-up elements to expand radially, as can be seen in FIGS. 7 and 8. The guide ramps 26 and 28 also include a plurality of flat surfaces 106 which are formed between adjacent ramps 104. These flat surfaces also allow space for connections and/or linkages (not shown) to travel axially and allow pivoting while keeping the parts connected. In one embodiment, the guide ramps 26 and 28 are formed in one piece by welding or casting. Those of ordinary skill in the art, however, will recognize that alternative methods can be employed to form the guide ramps 26 and 28.

Figure 8A:
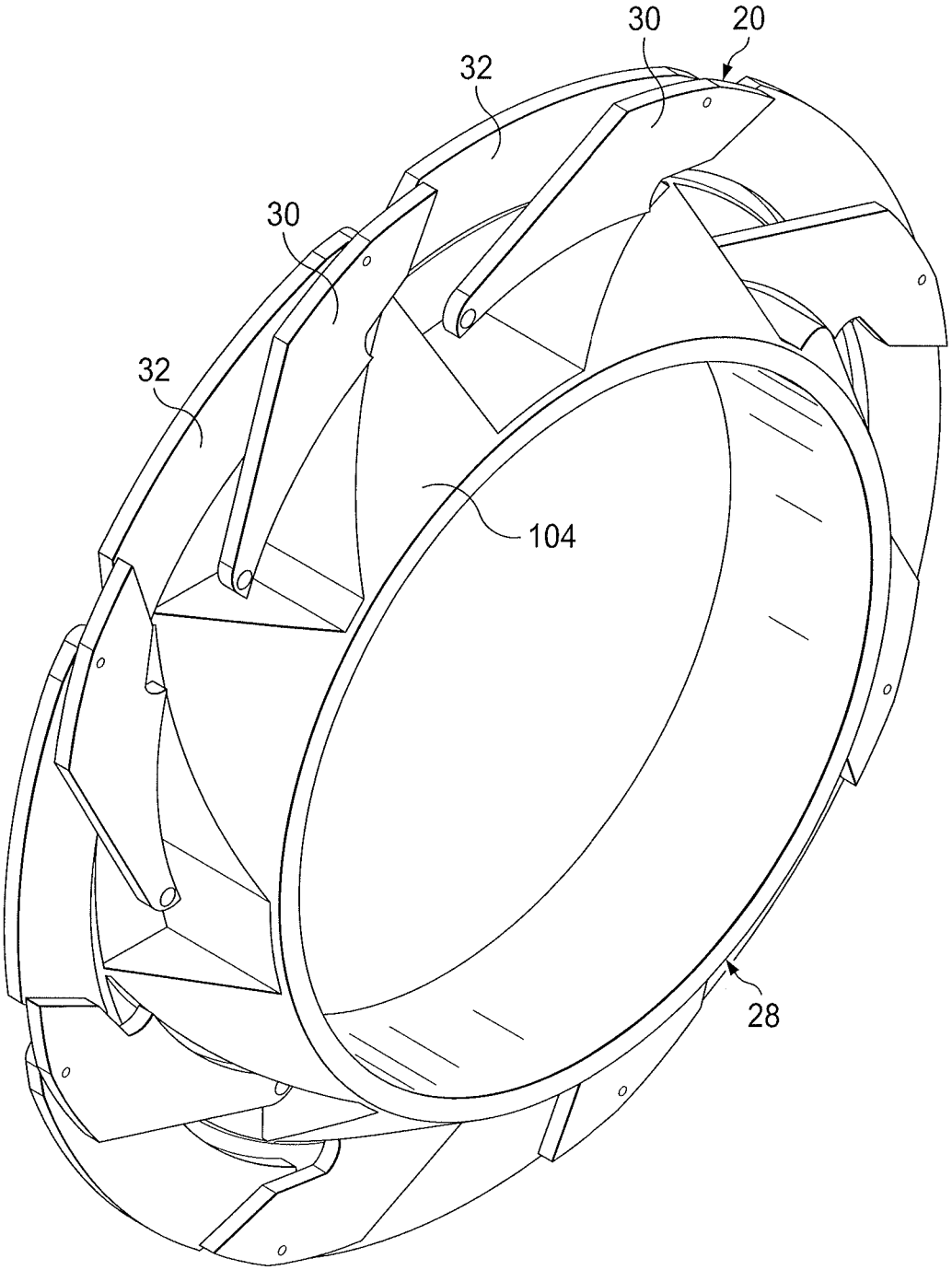
FIGS. 8A and 8B are two separate side perspective views of the back-up element and associated generally ring-shaped guide ramp showing the pivot blades making up the back-up element in an expanded state.
Figure 8B:
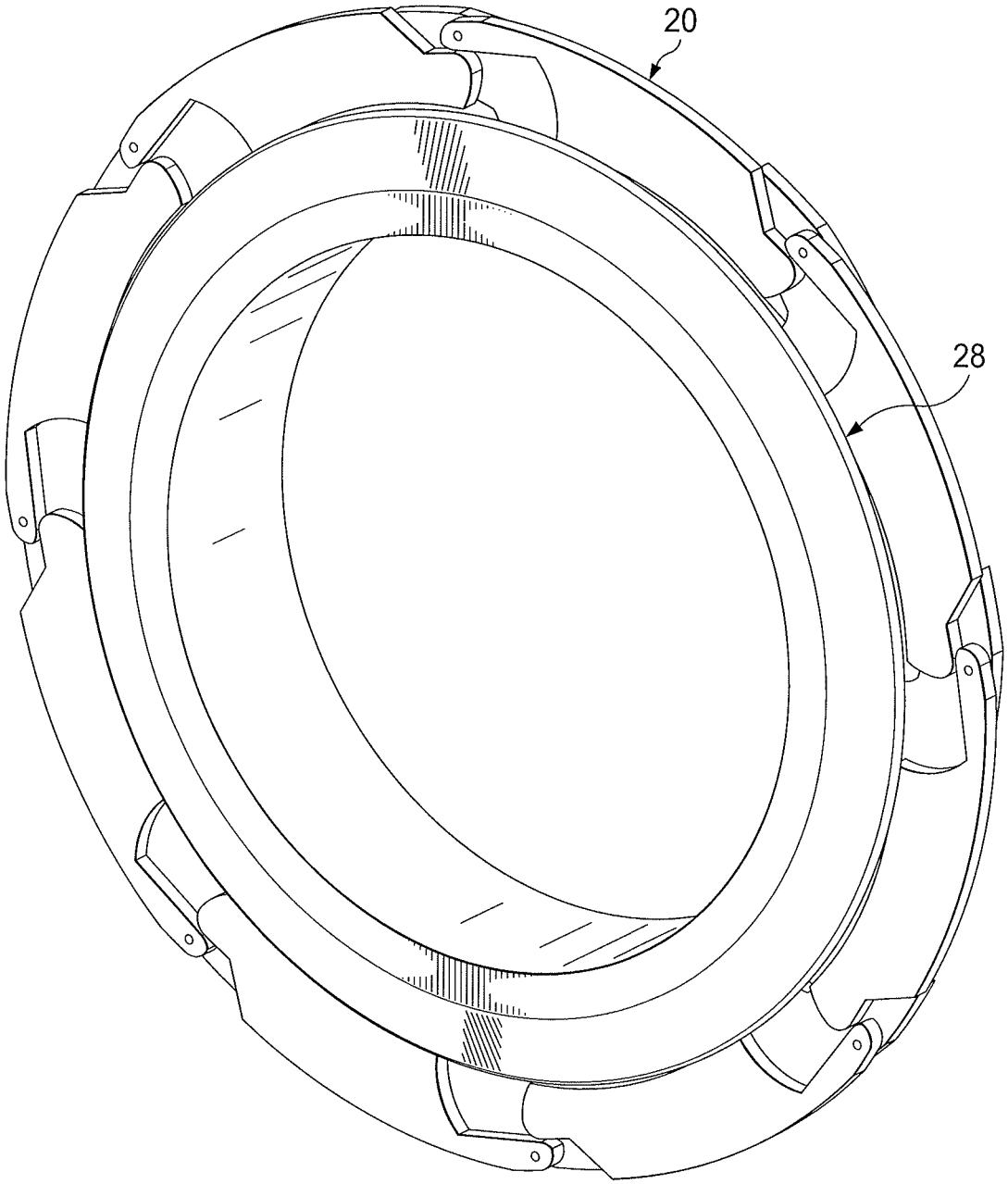

As shown in FIG. 7, the back-up element 20 is shown in the collapsed/retracted position. In this position, the blades 30, 32 rest at the bottom of the individual ramps 104. FIG. 8A shows the back-up element in the expanded position, the first set of blades 30 ride up and along the individual ramps 104. As they ride up and along the individual ramps 104, the first set of blades 30 pivot relative to the second set of blades 32. This action thereby causes the second set of blades 32 to flare outward which in turn expands the outer circumference of the back-up element 20. This condition is also illustrated in FIG. 8B, which shows the back-side view of the back-up element 20 in its expanded position. A similar action occurs with respect to the back-up element 18 as it rides up and along guide ramp 26.

Figure 3:
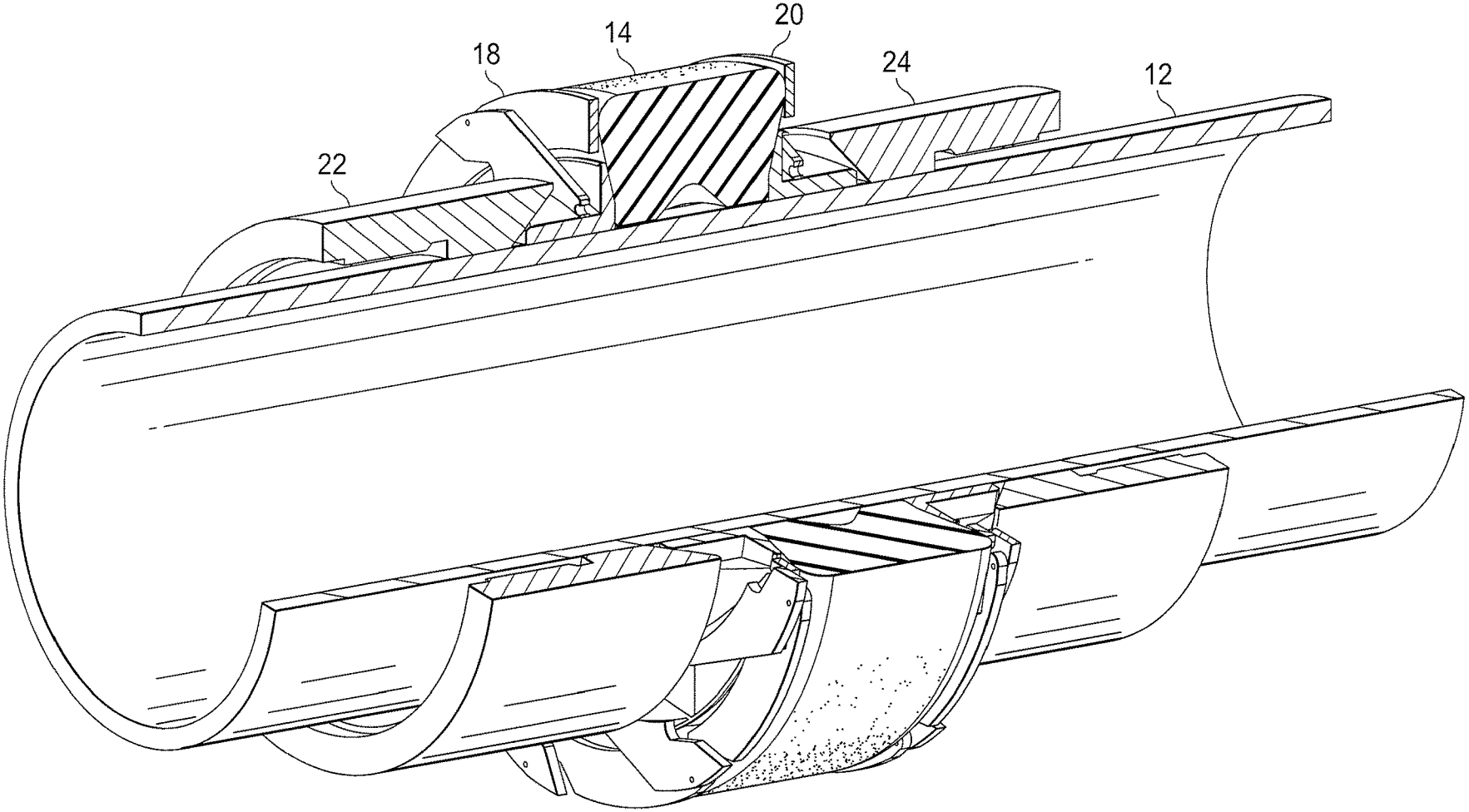
FIG. 3 is a partially cut-away perspective view of the annular seal assembly in accordance with the present disclosure showing the expandable and back-up elements in an expanded state.

Referring to FIG. 3, the guide rings 22 and 24 are more clearly illustrated via this partial cut-away view of the annular seal assembly 10. The guide rings 22 and 24 are formed of simple steel base pipe, similar to that used in forming the mandrel 12 and other downhole tubing used in this and other similar applications. The guide rings 22 and 24 are generally tubular members having an inner diameter that is slightly larger than the outer diameter of the mandrel 12 so as to allow the guide rings 22 and 24 to slide over the mandrel 12 during assembly of the annular seal assembly 12. In one embodiment, guide ring 24, which is the one located further downhole than the other guide ring is secured to the outer surface of the mandrel 12, e.g., by a threaded connection, welding or other similar attachment means. Alternatively, however, guide ring 24 is allowed to move axially along the outer surface of the mandrel 12. A downhole tool (not shown) or other similar mechanism is used to apply a downward force onto the upper guide ring 22 to thereby force both the upper and lower guide rings 22 and 24 to guide the back-up elements 18 and 20 along guide ramp 26 and 28 during activation of the expandable element 14. In the embodiment where the lower (i.e., further downhole oriented) guide ring 24 is permitted to move axially relative to the mandrel 12, some other fixed pipe or other axial retaining member will need to be employed to enable the guide ring 24 to guide the back-up element 20 along guide ramp 28.

As those of ordinary skill in the art will appreciate, multiple annular seal assemblies 10 may be employed along the inner surface of the tubing or casing string 16 to isolate different regions of the subterranean formation into which the tubing or casing string 16 is installed.

A method of sealing the annulus 15 between the mandrel 12 and a tubing string 16 is also provided herein. The method includes expanding the expandable element 14 disposed around the mandrel 12 until it contacts the inner diameter of the tubing string 16. As noted above, there are various types of expandable elements 14 which can be utilized for this purpose as well as various techniques for expanding those members, which are well known in the art. The method also includes expanding one or both of the back-up elements 18 and 20 from a retracted position to an expanded position. Once expanded, the out diameter of the back-up elements 18 and 20 comes into contact with or nearly into contact with the inner diameter of the tubing string 16. The back-up elements 18 and 20 are thereby able to prevent the expandable element from extruding outward into the annulus 15 beyond the back-up elements 18 and 20. They also aid in increasing the integrity of the seal created between the mandrel 12 and the tubing string 16 by the expandable element 14 by maintaining the structure of the expandable element 14.

As noted above, the back-up elements 18 and 20 are expanded by having the pivoting blades of each of the back-up elements ride along the respective generally ring-shaped guide ramps 26 and 28 disposed around the mandrel 12 on opposite ends of the expandable element 14 thereby moving them from a retracted position to an expanded position. As also noted above, the guide rings 22 and 24 guide the movement of the blades making up the back-up elements 18 and 20 up the guide ramps 26 and 28. As those of ordinary skill in the art will appreciate, the exact order in which the expansion of the expandable element 14 and back-up elements 18 and 20 is not critical. Those of ordinary skill will also appreciate that there are other implementation of the annular seal assembly 10 and ways of installing it within the annulus 15.

Although the present disclosure and its advantages have been described in detail, it should be understood that various changes, substitutions and alterations can be made herein without departing from the spirit and scope of the disclosure as defined by the following claims.

What is claimed is:

1. An annular sealing assembly, comprising:

a mandrel;

an expandable element disposed around the mandrel having a generally tubular shape and oppositely disposed longitudinal ends;

a generally ring-shaped guide ramp disposed around the mandrel adjacent one of the oppositely disposed longitudinal opposite ends of the expandable element;

a back-up element having a plurality of pivoting blades circumferentially secured in a ring, the back-up element being disposed around the mandrel adjacent the generally ring-shaped guide ramp and being capable of radially expanding and contracting upon longitudinal sliding movement along a longitudinally tapered surface of, and engagement with, the generally ring-shaped guide ramp;

a guide ring disposed around the mandrel adjacent the back-up element, the guide ring being capable of guiding the back-up element longitudinally along the generally ring-shaped guide ramp and providing structural support to a base of the expandable back-up element; and wherein the ring-shaped guide ramps comprise a first ring having a flat surface oriented in an axial direction, a second ring having a flat surface oriented in a radial direction, the flat surface of the first ring being formed perpendicular to the flat surface of the second ring, and a plurality of ramps formed between the first and second rings.

2. The annular sealing assembly according to claim 1, further comprising:

a second ring-shaped guide ramp disposed around the mandrel adjacent the other longitudinal end of the expandable element;

a second back-up element having a plurality of pivoting blades circumferentially secured in a ring, the second back-up element being disposed around the mandrel adjacent the second ring-shaped guide ramp and being capable of radially expanding and contracting upon longitudinal sliding movement along a longitudinally tapered surface of the second ring-shaped guide ramp; and a second guide ring disposed around the mandrel adjacent the second back-up element, the second guide ring being capable of guiding the second back-up element longitudinally along the second ring-shaped guide ramp.

3. The annular sealing assembly according to claim 2, wherein the mandrel is a section of production string.

4. The annular sealing assembly according to claim 3, wherein each of the ramps projects radially outward from the first ring and tapers radially and axially to the second ring.

5. The annular sealing assembly according to claim 4, wherein a flat surface is formed between adjacent ramps.

6. The annular sealing assembly according to claim 2, wherein the expandable element comprises a material selected from the group consisting of an elastomer, a rubber, a fluid filled bag, metallic elements, and combinations thereof.

7. The annular sealing assembly according to claim 2, wherein the plurality of pivoting blades in each of the back-up elements have an outer diameter (OD) which is less than an outer diameter (OD) of the expandable element and an inner diameter (ID) which conforms to an outer diameter (OD) of the mandrel when the pivoting blades are in the retracted position.

8. The annular sealing assembly according to claim 7, wherein the plurality of pivoting blades in each of the back-up elements are formed of two sets of blades which are connected to and pivot relative to each other in a circumferential direction with respect to an axis of the ring-shaped guide ramp, and the blades in the first set alternate in their placement around the circumference of the back-up elements with the blades in the second set and wherein blades in the first set are offset circumferentially from the blades in the second set.

9. The annular sealing assembly according to claim 8, wherein the blades of the first set are connected to and pivot relative the blades of the second set in at least one location.

10. The annular sealing assembly according to claim 9, wherein one of the two guide rings is fixed to the mandrel and the other of the two guide rings is allowed to move axially along the mandrel.

11. The annular sealing assembly according to claim 9, wherein both of the guide rings are allowed to move axially along the mandrel.

12. The annular sealing assembly according to claim 2, wherein the plurality of pivoting blades in each of the back-up elements have an outer diameter (OD) which conforms to an inner diameter (ID) of a section of tubing string into which the annular sealing assembly may be placed when the pivoting places are in the expanded position.

13. The annular sealing system according to claim 1, wherein each pivoting blade of the plurality of pivoting blades comprises an arcuate-shaped inner surface extending circumferentially about an axis of the ring-shaped guide ramp, wherein a totality of the arcuate-shaped inner surface of each pivoting blade is in contact with the ring-shaped guide ramp when the back-up element is in a contracted position.

14. A method of sealing an annulus between a mandrel and a tubing string, comprising:

expanding an expandable element disposed around the mandrel until it contacts an inner diameter of the tubing string, wherein the expandable element is disposed around the mandrel and has a tubular shape and oppositely disposed longitudinal ends;

wherein a ring-shaped guide ramp is disposed around the mandrel adjacent one of the oppositely disposed longitudinal ends of the expandable element;

expanding a back-up element disposed adjacent to the expandable element from a retracted position to an expanded position, the back-up element having a plurality of pivoting blades circumferentially secured in a ring, and the back-up element being disposed around the mandrel adjacent the ring-shaped guide ramp and being capable of radially expanding and contracting upon longitudinal sliding movement along a longitudinally tapered surface of the ring-shaped guide ramp, the blades in the expanded position coming in contact with the inner diameter of the tubing string and preventing the expandable element from extruding outward into the annulus beyond the back-up element;

wherein a guide ring is disposed around the mandrel adjacent the back-up element, the guide ring being capable of guiding the back-up element longitudinally along the ring-shaped guide ramp and providing structural support to a base of the back-up element; and wherein the ring-shaped guide ramps comprise a first ring having a flat surface oriented in an axial direction, a second ring having a flat surface oriented in a radial direction, the flat surface of the first ring being formed perpendicular to the flat surface of the second ring, and a plurality of ramps formed between the first and second rings.

15. The method according to claim 14, further comprising expanding a second back-up element disposed adjacent to the expandable element on the side opposite the other back-up element from a retracted position to an expanded position, the second back-up element having a plurality of pivoting blades circumferentially secured in a ring, the blades in the expanded position coming in contact with the inner diameter of the tubing string and preventing the expandable element from extruding outward into the annulus beyond the second back-up element.

16. The method according to claim 15, wherein the back-up elements are moved around the guide ramps by a pair of guide rings including the guide ring disposed adjacent to the respective back-up elements.

17. The method according to claim 16, wherein at least one of the guide rings moves axially along the mandrel.

18. The method according to claim 15, wherein the plurality of pivoting blades in each of the back-up elements are formed of two sets of blades which are connected to and pivot relative to each other as the back-up elements move from the retracted position to the expanded position.

19. The method according to claim 15, wherein the plurality of pivoting blades in each of the back-up elements expand to an outer diameter (OD) which conforms to an inner diameter (ID) of a section of tubing string into which the expandable element is placed when the back-up elements are expanded to the expanded position.

* * * * *